US009096065B2

(12) United States Patent
Nakano et al.

(10) Patent No.: US 9,096,065 B2
(45) Date of Patent: Aug. 4, 2015

(54) PRINTING APPARATUS AND METHOD FOR CONTROLLING PRINTING APPARATUS

(71) Applicant: CANON KABUSHIKI KAISHA, Tokyo (JP)

(72) Inventors: Takatoshi Nakano, Yokohama (JP); Minoru Teshigawara, Saitama (JP); Susumu Hirosawa, Tokyo (JP); Seiji Suzuki, Ebina (JP); Kentarou Muro, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 169 days.

(21) Appl. No.: 13/788,430

(22) Filed: Mar. 7, 2013

(65) Prior Publication Data

US 2013/0257976 A1 Oct. 3, 2013

(30) Foreign Application Priority Data

Mar. 28, 2012 (JP) ..... 2012-074709

(51) Int. Cl.

| | |
|---|---|
| ***B41J 2/165*** | (2006.01) |
| ***B41J 2/17*** | (2006.01) |
| ***B41J 2/175*** | (2006.01) |
| ***B41J 2/18*** | (2006.01) |

(52) U.S. Cl.

CPC ..... *B41J 2/16535* (2013.01); *B41J 2/16532* (2013.01); *B41J 2/16538* (2013.01); *B41J 2/16585* (2013.01)

(58) Field of Classification Search

USPC ..... 347/89

See application file for complete search history.

(56) References Cited

U.S. PATENT DOCUMENTS

| | | | | |
|---|---|---|---|---|
| 5,956,062 | A * | 9/1999 | Omata et al. | 347/89 |
| 6,623,093 | B2 | 9/2003 | Takahashi et al. | |
| 6,994,416 | B2 | 2/2006 | Seki et al. | |
| 7,011,386 | B2 | 3/2006 | Iwasaki et al. | |
| 7,114,795 | B2 | 10/2006 | Shimura et al. | |
| 7,144,096 | B2 | 12/2006 | Seki et al. | |
| 7,374,267 | B2 | 5/2008 | Oshio et al. | |
| 7,396,095 | B2 | 7/2008 | Nakagawa et al. | |
| 7,399,046 | B2 | 7/2008 | Teshigawara et al. | |
| 7,448,721 | B2 | 11/2008 | Oshio et al. | |
| 7,465,006 | B2 | 12/2008 | Edamura et al. | |
| 7,673,959 | B2 | 3/2010 | Maru et al. | |
| 7,883,187 | B2 * | 2/2011 | Kawase | 347/84 |
| 8,061,805 | B2 | 11/2011 | Suzuki et al. | |

(Continued)

FOREIGN PATENT DOCUMENTS

JP 08-244250 A 9/1996

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

To provide an ink jet printing apparatus which can reduce waste ink as much as possible and shorten the amount of time spend on the following wiping process, and a recovery operation method therefor, whereby a first process and a second process are carried out, the first process for discharging ink that does not contribute to the printing from the print head while supplying ink from the ink reservoir portion to the print head by way of the first ink passage connected to one end of the print head, and the second process for discharging ink that does not contribute to the printing from the print head while supplying ink from the ink reservoir portion to the print head by way of the second ink passage connected to the other end of the print head.

11 Claims, 13 Drawing Sheets

(56) References Cited

U.S. PATENT DOCUMENTS

| | | | | |
|---|---|---|---|---|
| 8,317,290 | B2 | 11/2012 | Edamura et al. | |
| 8,398,206 | B2 | 3/2013 | Yamamoto et al. | |
| 2001/0043250 | A1* | 11/2001 | Faisst et al. | 347/22 |
| 2008/0055357 | A1 | 3/2008 | Hamasaki et al. | |
| 2010/0033531 | A1 | 2/2010 | Suzuki et al. | |
| 2010/0141722 | A1* | 6/2010 | Saito et al. | 347/92 |
| 2010/0321425 | A1* | 12/2010 | Kanke et al. | 347/6 |
| 2012/0154476 | A1 | 6/2012 | Doi et al. | |
| 2012/0206522 | A1 | 8/2012 | Kanda et al. | |
| 2012/0206523 | A1 | 8/2012 | Hirosawa et al. | |
| 2012/0206524 | A1 | 8/2012 | Hirosawa et al. | |
| 2012/0299996 | A1 | 11/2012 | Kano et al. | |
| 2013/0100199 | A1 | 4/2013 | Suzuki et al. | |
| 2013/0100205 | A1 | 4/2013 | Sunouchi et al. | |

* cited by examiner

PRINTING APPARATUS AND METHOD FOR CONTROLLING PRINTING APPARATUS

BACKGROUND OF THE INVENTION

1. Field of the Invention

The present invention relates to a printing apparatus which ejects ink to carry out printing and to a method for controlling printing apparatus More specifically, the invention relates to a printing apparatus which carries out a recovery operation by circulating ink between a print head and an ink tank and to a method for controlling the printing apparatus.

2. Description of the Related Art

An ink jet printing apparatus ejects fine ink droplets from a nozzle of a print head on a print medium such as a sheet of paper so as to print characters and images on the print medium. The conventionally known ink jet printing apparatus, in order to prevent the defective ejection, removes ink in the nozzle whose viscosity increases and then supplies new ink into the nozzle, or carries out the recovery operation of an ink jet print head by eliminating microbubbles mixed in the ink. As a specific method for recovery operation, there is a preliminary ejection recovery operation method in which ink droplets are ejected from a nozzle of the print head on a waste ink receiver such as a cap, and an ink pressure recovery method in which pressure is applied to ink in the nozzle to forcedly discharge the ink on the waste ink receiver such as a cap. There is also a suction recovery method in which ink is sucked out from the nozzle by, for example, a suction cap.

Japanese Patent Laid-Open No. H08-244250 (1996) discloses a printing apparatus having two pumps in a circulation passage, and provided with two ink passages on both inlet and outlet sides of the print head for connecting a print head to an ink tank, wherein at the time of terminating the circulation operation, the pump on the outlet side is stopped in advance, followed by the stop of the pump on the inlet side. Therefore, the pressure is applied to the inside of the print head to eliminate bubbles from the nozzle in the print head.

A line-type print head has been conventionally known in which a plurality of nozzle chips is aligned in a regular manner such as a staggered arrangement. If the pressure recovery method disclosed in Japanese Patent Laid-Open No. H08-244250 (1996) is applied to such an elongated print head having the structure as mentioned above, the problem arises as follows. A pressure loss within the ink passage in the print head generates the difference in ink discharge timing between a nozzle of a nozzle chip near a pressure recovery source (such as a pump) and a nozzle of a nozzle chip far from the pressure recovery source when the pressure recovery operation is carried out. The nozzle of the nozzle chip near the pressure recovery source discharges ink earlier, and a delay occurs in discharge of ink from the nozzle of the nozzle chip far from the pressure recovery source.

Therefore, in the case where the print head discharges the necessary amount of ink for removing the ink whose viscosity increases and eliminating microbubbles, the nozzle near the pressure recovery source discharges larger amount of ink than that primarily required if the nozzle far from the recovery source discharge necessary amount of ink. As described above, the larger amount of ink discharged than that primarily required for removing the ink whose viscosity increases and eliminating microbubbles results in the waste of ink consumption. Furthermore, since ink spills out of the nozzle at the time of pressure recovery operation, the following wiping process for wiping the ink from the nozzle surface is required. At that time, if more ink spills out than necessary, a single wiping operation cannot completely wipe out the ink on the nozzle surface, and thus the ink may remain on the nozzle surface.

SUMMARY OF THE INVENTION

One of objects of the present invention is thus to provide an ink jet printing apparatus which can reduce waste ink as much as possible and shorten the amount of time spend on the following wiping process, and a recovery operation method therefor.

Therefore, a feature of a printing apparatus of a first aspect of the present invention is to provide a print head having nozzle arrays including a plurality of nozzles arranged thereon, the plurality of nozzles ejecting ink stored in an ink reservoir portion; a first ink passage connecting one end side of the nozzle arrays to the ink reservoir portion of the print head; a second ink passage connecting the other end side of the nozzle arrays to the ink reservoir portion of the print head; and a control device adapted to carry out a first operation and a second operation, the first operation discharging ink that does not contribute to the printing from the print head while supplying ink from the ink reservoir portion to the print head by way of the first ink passage, and the second operation discharging ink that does not contribute to the printing from the print head while supplying ink from the ink reservoir portion to the print head by way of the second ink passage.

Thereby, it has been possible to achieve the ink jet printing apparatus which can reduce waste ink as much as possible and shorten the amount of time spend on the following wiping process.

Further features of the present invention will become apparent from the following description of exemplary embodiments (with reference to the attached drawings).

DESCRIPTION OF THE EMBODIMENTS

First Embodiment

A first embodiment of the present invention will be described below with reference to drawings.

[Structure of Printing Apparatus]

Figure 1:
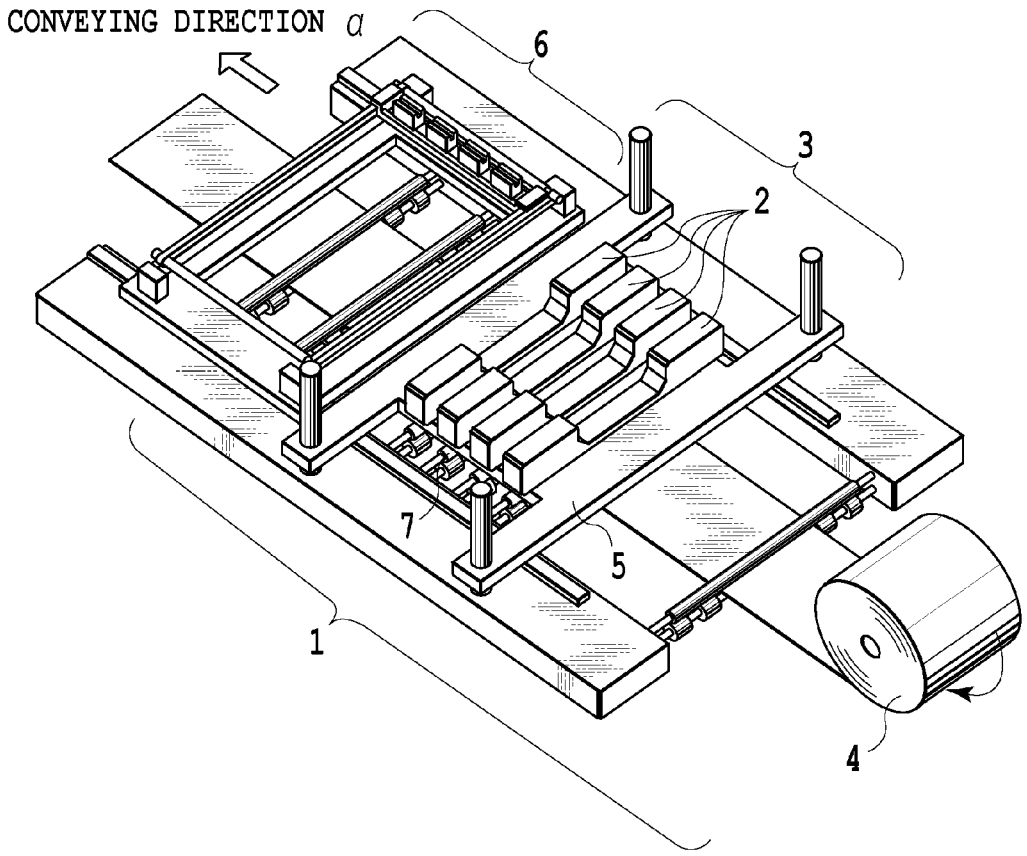
FIG. 1 is a perspective view showing a structure of a main portion concentrating on a printing unit of a printing apparatus.
Figure 2:
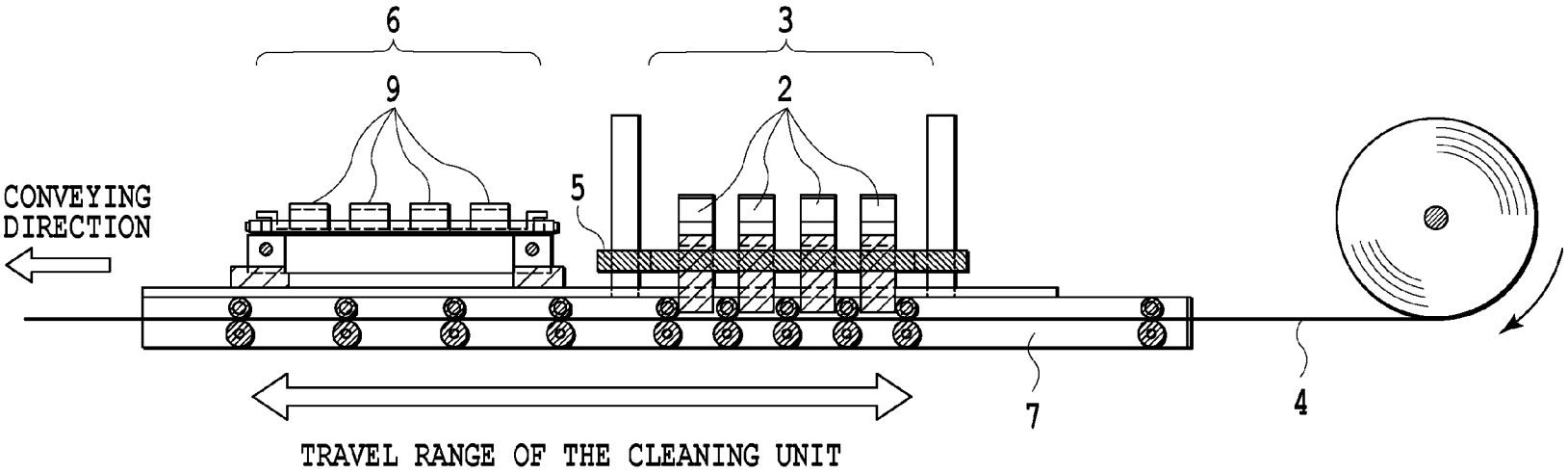
FIG. 2 is a cross sectional view showing a cross-section structure of FIG. 1.
Figure 3:
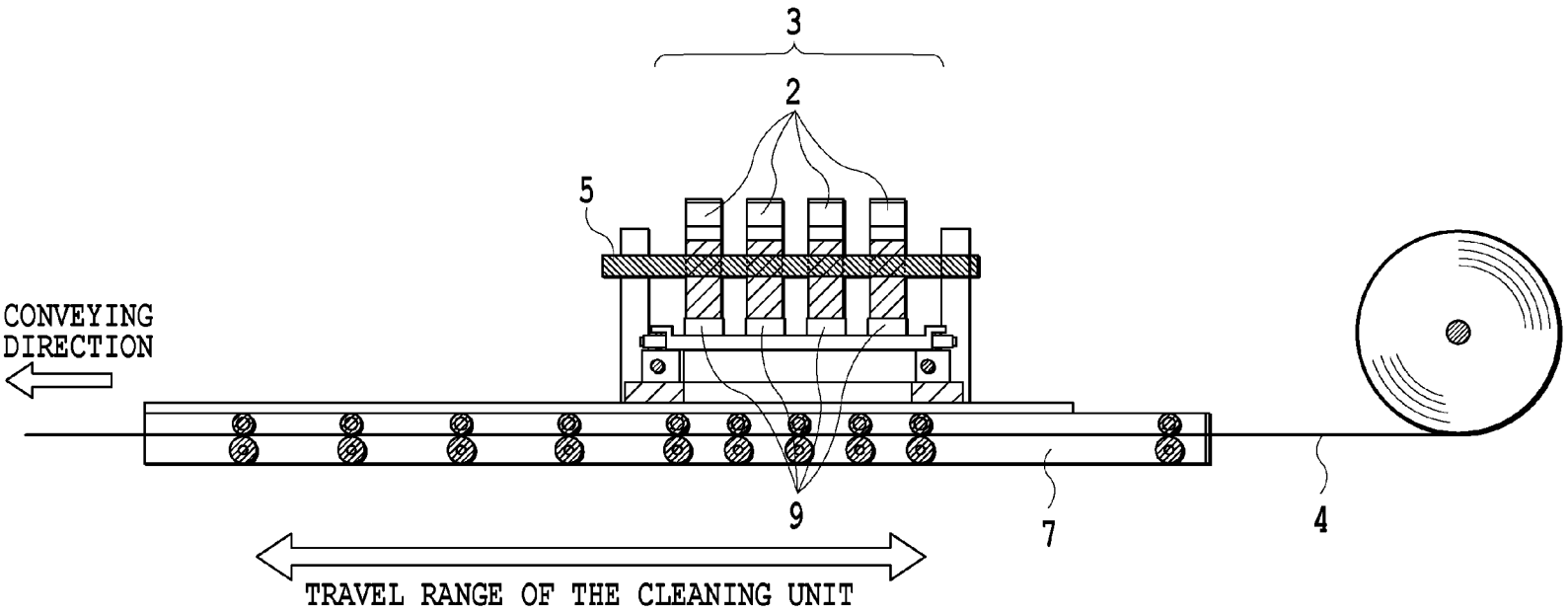
FIG. 3 is a cross sectional view showing a status at the time of cleaning operation.

FIG. 1 is a perspective view showing a structure of a main portion concentrating on a printing unit of a printing apparatus according to the present embodiment. FIG. 2 is a cross sectional view showing a cross-section structure of FIG. 1. FIG. 3 is a cross sectional view showing a status at the time of cleaning operation. A printing apparatus 1 of the present embodiment is a line printer which carries out the printing using an elongated line-type print head to continuously transport a print medium in a conveying direction (a first direction) that is the direction shown by an arrow α.

The printing apparatus 1 is provided with a holder for holding a print medium 4 such as a continuous sheet wound in a roll shape, a transport mechanism 7 for transporting the print medium 4 in a first direction at a predetermined speed, and a printing unit 3 for carrying out the printing by means of a print head on the print medium 4. In addition, the print medium is not limited to the continuous print medium in a roll shape, but may be a cut print medium. Moreover, the printing apparatus 1 is provided with a cleaning unit 6 for removing a sticking substance stuck on a nozzle surface of the print head, as well as a cutter unit for cutting the print medium 4, a drying unit for forcedly drying the print medium, and a discharge tray, each of which is provided downstream of the printing unit 3 along a print medium transport path. The printing unit 3 is provided with a plurality of print heads 2 each of which corresponds to a plurality of ink colors.

Although the present embodiment employs four print heads corresponding to four colors, namely C (cyan), M (magenta), Y (yellow), and K (black), the number of colors is not limited thereto. Ink of each color is individually supplied from an ink tank (an ink reservoir portion) in which the ink is stored to the print head 2 via an ink tube. The plurality of print heads 2 is integrally held by a head holder 5, and the head holder 5 is configured to be movable upward and downward so that the distance between the plurality of print heads 2 and the print medium 4 can be varied. Furthermore, a mechanism is provided that enables the head holder 5 to be translated in a second direction intersecting with the first direction.

The cleaning unit 6 has a plurality of (four) cleaning mechanisms 9 corresponding to the plurality of (four) print heads 2. Details of each of the cleaning mechanisms 9 will be described below. The cleaning unit 6 is configured to be slidably move in the first direction (the direction of an arrow α) by a drive motor (not shown). FIGS. 1 and 2 show the status at the time of printing, in which the cleaning unit 6 is located downstream of the print medium transport direction with regard to the printing unit. In contrast, FIG. 3 shows the status at the time of cleaning operation, in which the cleaning unit 6 is located immediately below the print heads 2 of the printing unit 3. FIGS. 2 and 3 indicate the operable range of the cleaning unit 6 by an arrow.

Figure 4A:
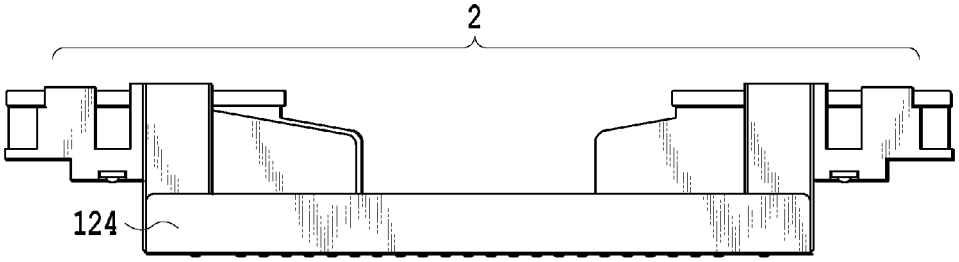
FIG. 4A is a diagram showing a structure of the print heads.
Figure 4B:
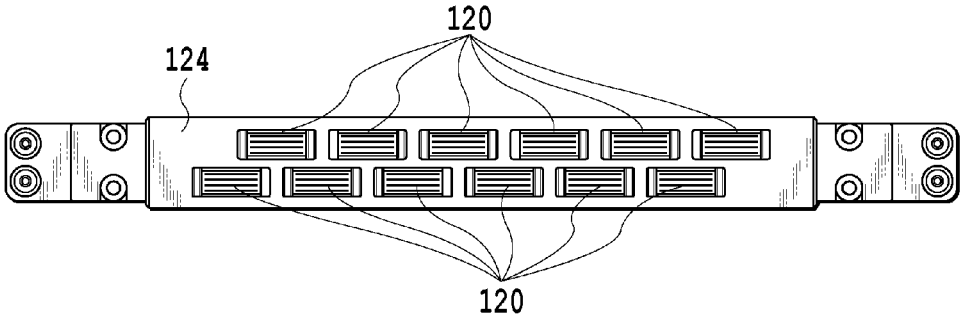
FIG. 4B is a diagram showing a structure of the print heads.

FIGS. 4A and 4B are diagrams showing a structure of the print head 2. As the ink jet system, it is possible to employ a system using a heater element, a system using a piezo element, a system using an electrostatic element, a system using a MEMS element, etc. The print head 2 is a line-type print head in which nozzle arrays of the ink jet system is formed to the extent of covering the maximum width of the print medium that is expected to be used. The nozzle arrays align in the second direction. A plurality of nozzle chips 120 is aligned on a base substrate 124 along the second direction As shown in FIG. 4B, the plurality of (twelve in the present embodiment) nozzle chips 120 having the dimensions and structures identical to one another forms two staggered rows aligned in a regular manner entirely in the second direction (the direction of width of the print medium). More specifically, in the print heads 2, a plurality of first nozzle chips and a plurality of second nozzle chips each having the nozzle arrays are aligned as being the rows different to each other along the second direction, and the first nozzle chips and the second nozzle chips adjacent to each other have the positional relationship in which they are shifted to each other in the second direction. In the first nozzle chips and the second nozzle chips adjacent to each other, the nozzle arrays included therein are partially overlapped to one another in the second direction.

Figure 5:
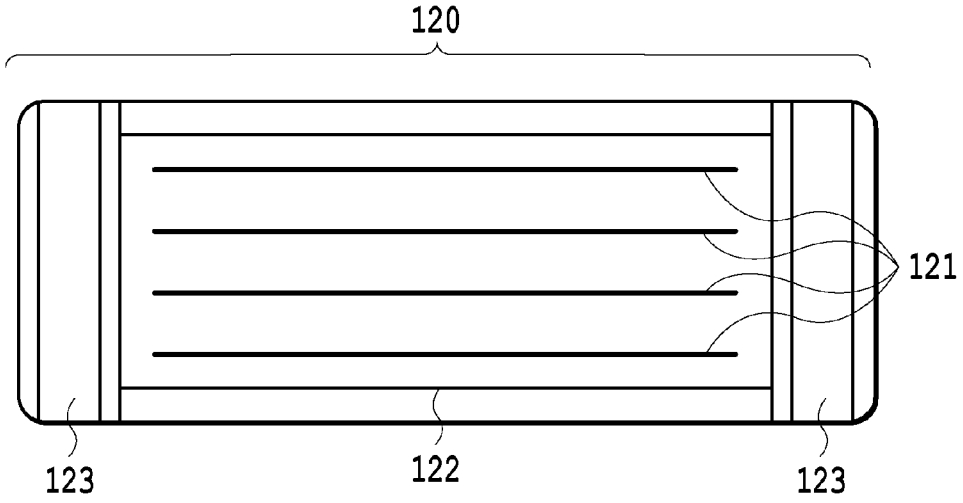
FIG. 5 is a diagram showing a structure of a nozzle chip constituting the print head.

FIG. 5 is a diagram showing a structure of the nozzle chip 120 constituting the print head 2. The nozzle chip 120 is provided with a nozzle surface 122 on which a plurality of nozzle arrays 121 for ejecting ink is formed, and also has a nozzle substrate on which an energy element formed corresponding to each nozzle is embedded. The plurality of (four in the present embodiment) nozzle arrays 121 is provided as four rows in parallel with respect to the first direction. The nozzle substrate of the nozzle chip 120 is provided on the base substrate 124. The nozzle substrate and the base substrate 124 are connected by way of an electric connection portion interposing therebetween, and the electric connection portion is protected by being covered with a sealing portion 123 made from a resin material so as to avoid causing corrosion and breaking of wire.

Figure 6:
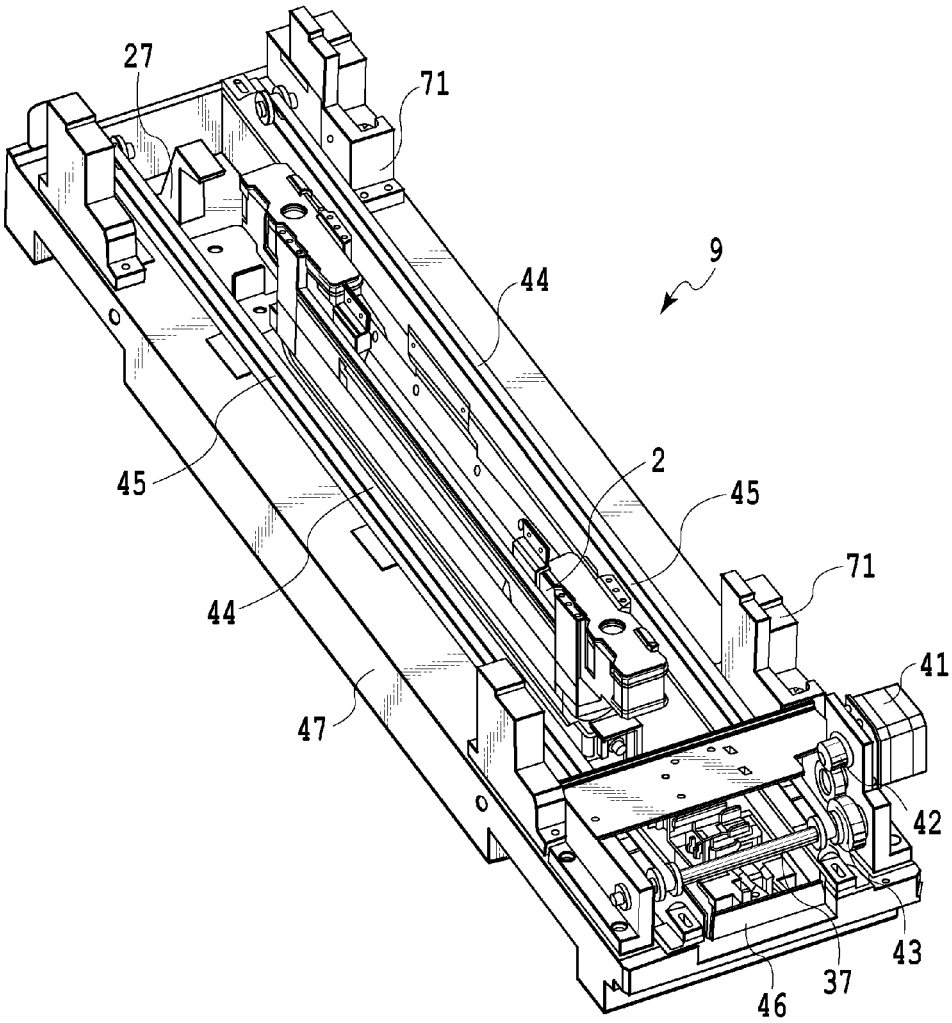
FIG. 6 is a perspective view showing detailed structures of a cleaning unit and a cleaning mechanism.
Figure 7:
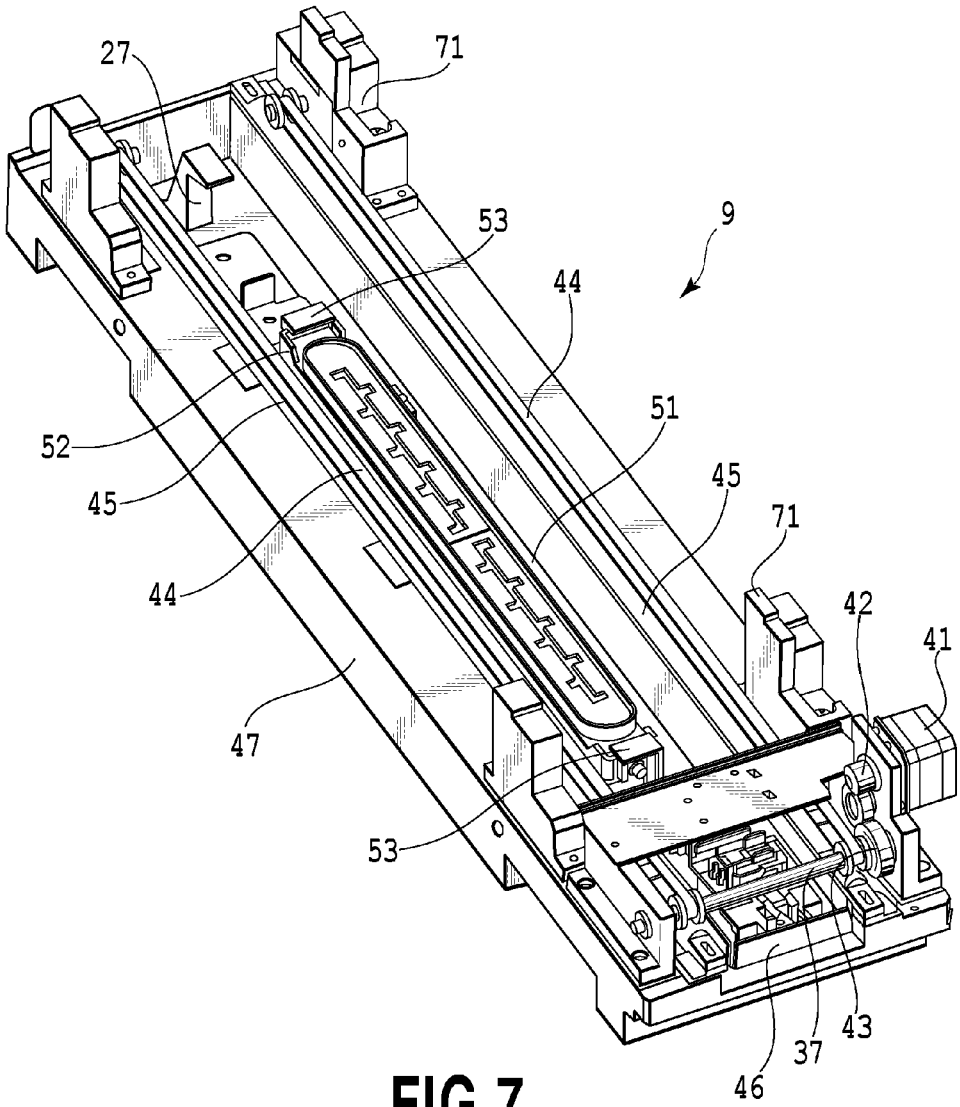
FIG. 7 is a perspective view showing detailed structures of a cleaning unit and a cleaning mechanism.

FIGS. 6 and 7 are perspective views showing detailed structures of the cleaning unit 6 and the cleaning mechanism 9. FIG. 6 shows the status in which the print head is placed on the cleaning mechanism (the time of cleaning operation), and FIG. 7 shows the status in which the print head 2 is not placed on the cleaning mechanism. The cleaning unit 6 is provided with the cleaning mechanism 9, a cap 51, and a positioning member 71. The cleaning mechanism 9 has a wiper unit 46 for removing sticking substances stuck on the nozzle surface of the print head 2, a travel mechanism for moving the wiper unit 46 in the second direction (the wiping direction), and a frame 47 for integrally supporting these two components.

The travel mechanism moves the wiper unit 46 guided and supported by two shafts 45 in the second direction by the driving of a drive source. The drive source has a drive motor 41 and deceleration gears 42 and 43 to rotate a drive shaft 37. The rotation of the drive shaft 37 is conveyed by means of a belt 44 and a pulley to move the wiper unit 46. In FIG. 7, the cap 51 is held by a cap holder 52. The cap holder 52 is energized perpendicularly to the nozzle surface of the print head 2 by a spring which is an elastic body, and is able to move against the spring.

While the frame 47 is placed at the position of the cap, the print head 2 moves perpendicularly to the nozzle surface to come into close contact with and separate from the cap 51. Capping of the nozzle surface by the close contact blocks the nozzle out from the atmosphere, thereby suppressing drying thereof. Furthermore, in order for the cap 51 to remove ink in the nozzle whose viscosity increases, ink droplets are collected that are discharged by a so-called preliminary ejection for discharging the ink which does not contribute to printing. The positioning member 71 comes into contact with a head positioning member provided on the head holder 5 in the first direction, in the second direction and perpendicular to the nozzle surface (in a third direction) during the cleaning operation and the capping to determine the positional relationship between the print head 2 and the cleaning unit 6.

Figure 8:
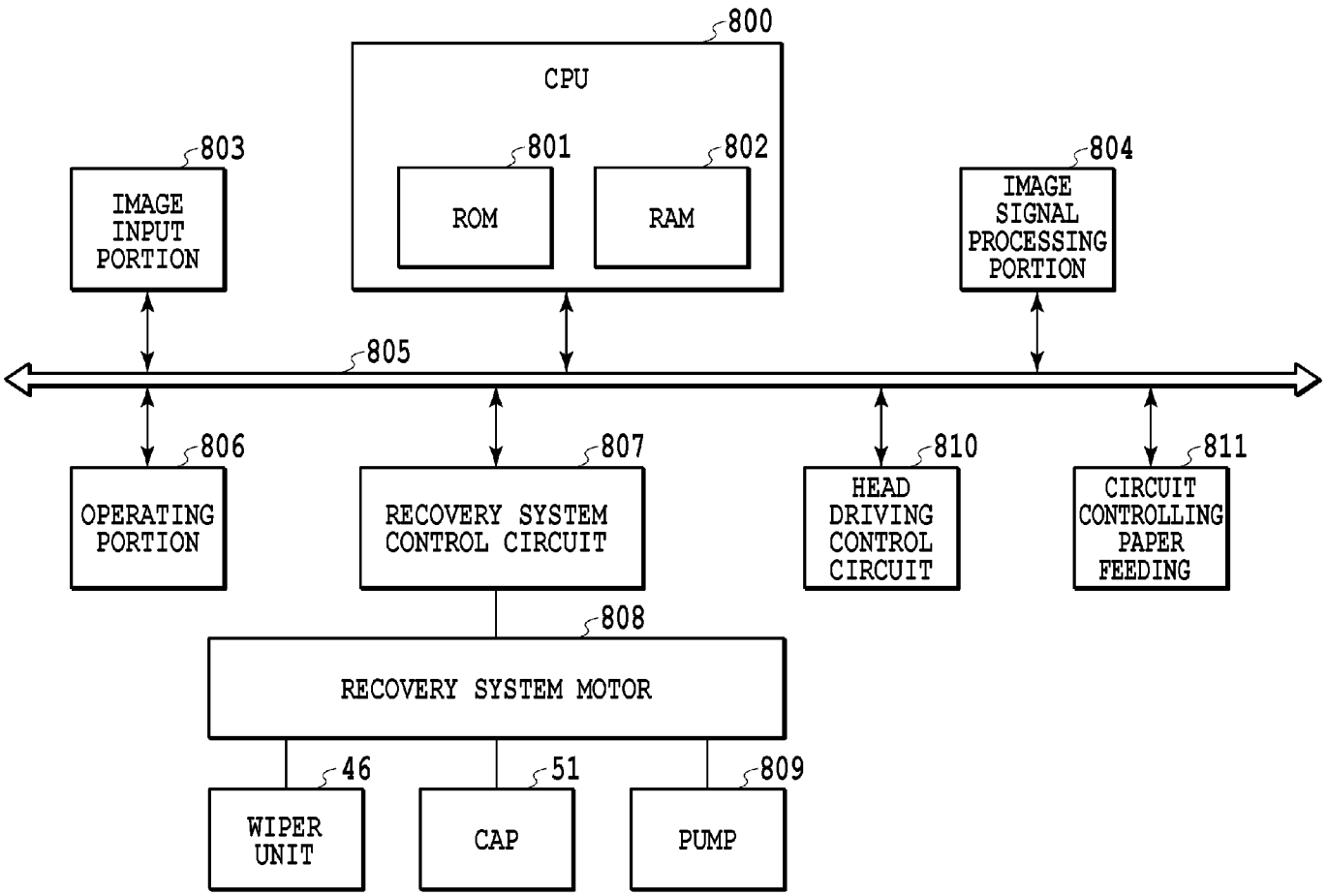
FIG. 8 is a block diagram showing a control structure of the ink jet printing apparatus.

FIG. 8 is a block diagram showing a control structure of the ink jet printing apparatus according to the present embodiment. The control structure of the ink jet printing apparatus according to the present embodiment is broadly divided into software-based processing device and hardware-based processing device. The software-based processing device includes an image input portion 803, an image signal processing portion 804 corresponding thereto, a central control unit CPU 800, etc., each of which has access to a main bus line 805. The hardware-based processing device includes an operating portion 806, a recovery system control circuit 807, a head driving control circuit 810, a circuit 811 controlling paper feeding in the print medium direction, etc.

The CPU 800 generally has a ROM (read only memory) 801 and a RAM (random access memory) 802, and carries out the printing by giving an appropriate printing condition to input information so as to drive the print head 2. Furthermore, a program that executes a recovery timing chart of the print head 2 in advance is stored in the RAM 802, so that the recovery condition such as the condition of the preliminary ejection into the cap 51 is given to the recovery system control circuit 807 and the print head 2 as required. A recovery system motor 808 drives the print head 2, the wiper unit 46 and the cap 51 oppositely spaced from the print head 2, and a suction pump 809 for sucking the ink discharged into the cap 51. The head driving control circuit 810, which executes the driving condition of an electro-thermal converter used to eject ink from the print head 102, generally makes the print head 2 implement the preliminary ejection and ink ejection for printing.

Figure 9:
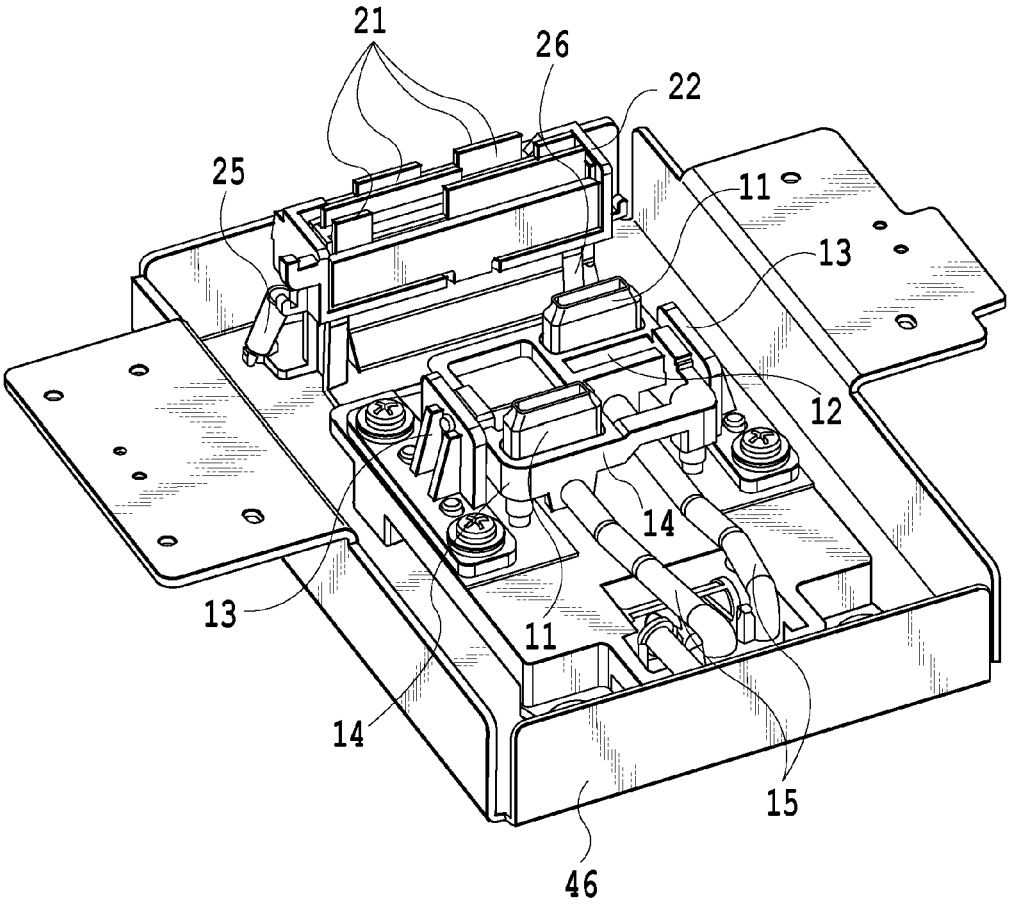
FIG. 9 is a diagram showing the structure of the wiper unit.

FIG. 9 is a diagram showing a structure of the wiper unit 46 (the wiping mechanism). Two suction ports 11 (first and second suction device) are provided corresponding to the first and second nozzle chip arrays. Two suction ports 11 have the same interval in the first direction as that between two nozzle chip arrays. Two suction ports 11 has the same or approximately same amount of misalignment (a predetermined distance) between the adjacent nozzle chips in two nozzle chip arrays in the second direction.

The suction ports 11 are held by a suction holder 12 The suction holder 12 is energized by a spring 14, which is an elastic body, perpendicular to the nozzle surface of the print head 2 (the third direction) and is able to move in the third direction against the spring. This displacement mechanism is for absorbing the movement of the moving suction ports 11 upon going beyond the protruding sealing portion 123.

Two suction ports 11 is connected with tubes 15 via the suction holder 12, and the tubes 15 is connected with a negative pressure generating device such as a suction pump. Operating the negative pressure generating device applies a negative pressure for sucking ink and dirt to the inside of the suction ports 11. Two blades 21 on each of the left and right sides, namely four blades in total, are held by a blade holder 22. The blade holder 22 is supported about an axis at both the ends thereof in the first direction so as to be configured to be rotatable about the first direction as a rotational axis. The blade holder 22 is generally energized by a spring 25 with regard to a stopper 26.

In the blades 21, the orientation of the blade surface at the wiping position and at the retract position can be switched by the operation of a switching mechanism described later. The suction holder 12 and the blade holder 22 are mounted on a shared supporting body of the wiper unit 46. Each of the blades held in this way moves relative to the print head 2, so that the wiping of the nozzle is carried out.

Figure 10:
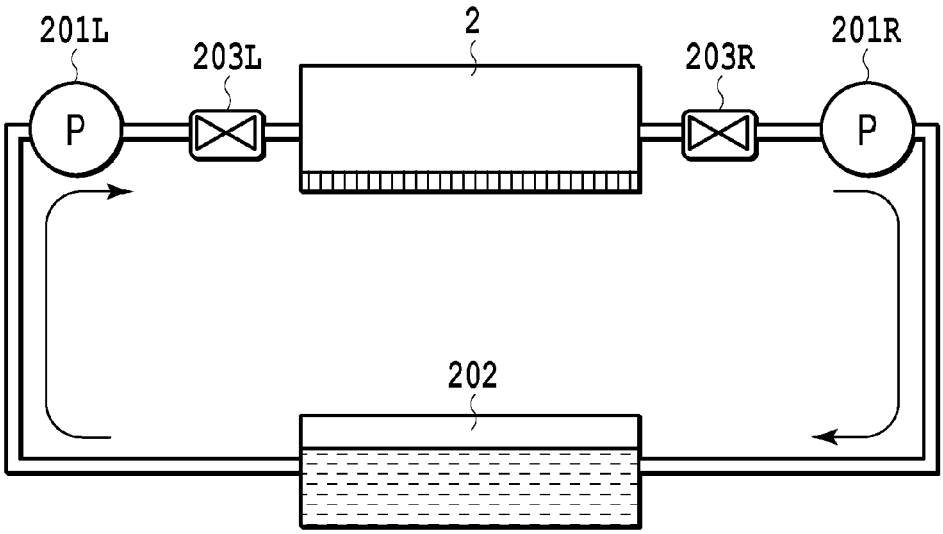
FIG. 10 is a diagram showing a circulation passage for the circulation between the print head and the ink tank.

FIG. 10 shows a circulation passage connecting the print head 2 to an ink tank 202 in a simple fashion, in which the status of circulating a normal ink circulation is shown here. A pump 201L and a pump 201R are driven to supply ink from the ink tank 202 through a circulation passage (a first ink passage) to the print head 2, and then return the ink from the print head 2 through the circulation passage (a second ink passage) to the ink tank 202. Such ink flow (in the forward direction) circulates the ink. Moreover, a valve 203L and a valve 203R are provided for carrying out the opening/closing operation in the circulation passage, and each of the valves opens herein.

Figure 11A:
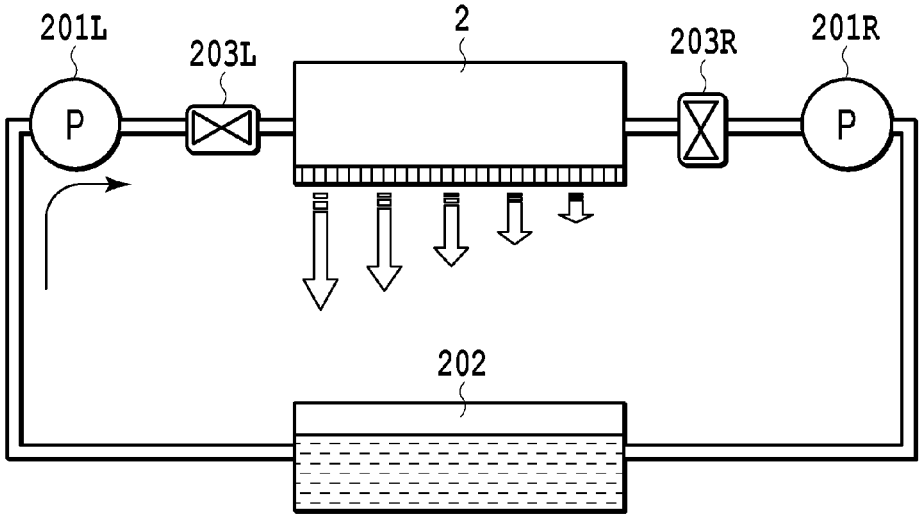
FIG. 11A is a schematic diagram showing the circulation passage between the print head and the ink tank.
Figure 11B:
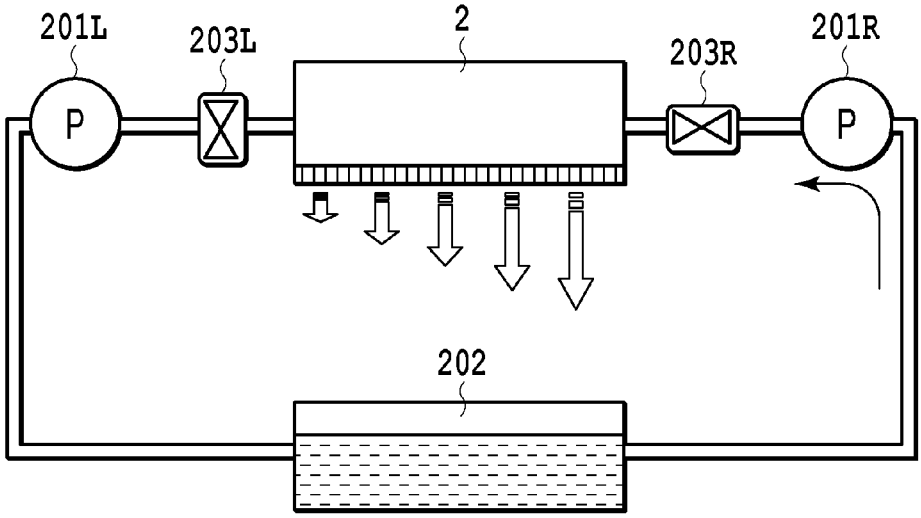
FIG. 11B is a schematic diagram showing the circulation passage between the print head and the ink tank.

FIGS. 11A and 11B are schematic diagrams showing the circulation passage between the print head 2 and the ink tank 202 of the present embodiment. In FIG. 11A, when the left pump 201L is driven upon opening a valve 203L located on the left side (at one end) (in the nozzle alignment direction) of the print head 2 and closing a valve 203R on the right side (at the other end), the print head 2 goes into a pressurized state. At that time, a pressure loss within the ink passage in the print head 2 generates the difference in discharge timing between the nozzle of the nozzle chip near the left pump 201L that is a pressure source and the nozzle of the nozzle chip far from the left pump 201L.

Specifically, the nozzle of the nozzle chip near the left pump 201L discharges ink earlier, and a delay occurs in discharge of ink from the nozzle of the nozzle chip which is far from the left pump 201L and whose pressure loss thus increases. This results in larger amount of ink being discharged from the nozzle of the nozzle chip near the left pump 201L, as shown by a thick arrow in figure. Then, the pressurizing operation is carried out as shown in FIG. 11A, and then the pressurizing operation is carried out from the reverse direction as shown in FIG. 11B. Specifically, the right pump 201R is driven upon opening the valve 203R on the right side and closing the valve 203L on the left side.

In this way, the print head 2 going into the pressurized state increases the amount of ink discharged from the nozzle chip on the left side in FIG. 11A, while the amount of ink discharged from the nozzle chip on the right side is increased as shown in figure by a thick arrow in FIG. 11B. As described above, the pressurizing operation carried out from left and the pressurizing operation carried out from right are alternately carried out to the print head 2 sequentially, so that it has been possible to equalize the amount of ink discharged from the nozzle chips arranged all over the print head 2. Thereby, it has been possible to achieve the ink jet printing apparatus which can reduce waste ink as much as possible and shorten the amount of time spend on the following wiping process.

Second Embodiment

A second embodiment of the present invention will be described below with reference to drawings. Since the basic structure of the present embodiment is similar to that of the first embodiment, description will be made below only regarding the characteristic structure.

Figure 12A:
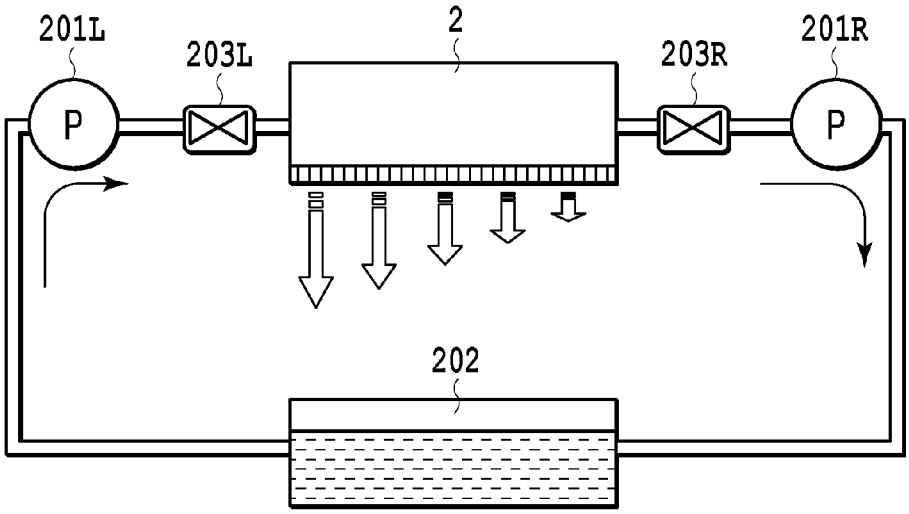
FIG. 12A is a schematic diagram showing a pressurizing operation.
Figure 12B:
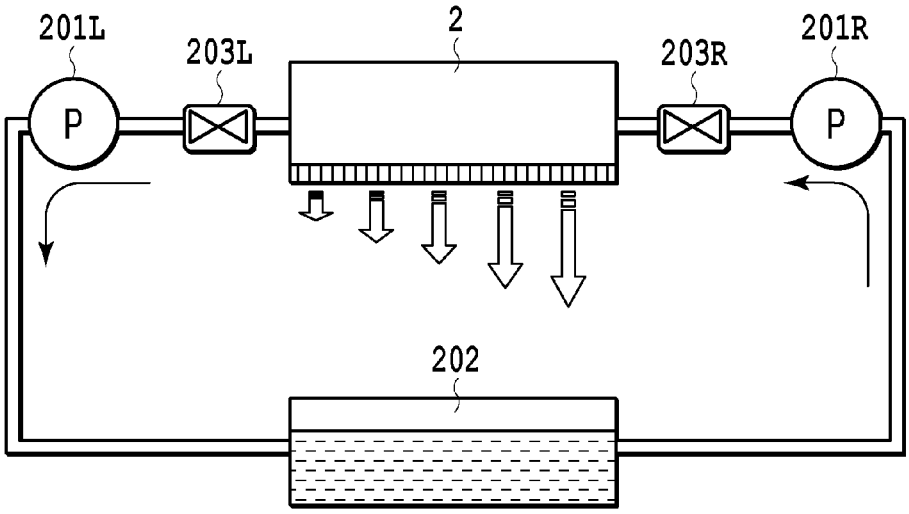
FIG. 12B is a schematic diagram showing a pressurizing operation.

FIGS. 12A and 12B are schematic diagrams showing a pressurizing operation that is the characteristic of the present embodiment. In the present embodiment, the pressurizing operation is carried out while both the valve 203L and the valve 203R are opened. As shown in FIG. 12A, both the valve 203L and the valve 203R are opened and the driving speed of the right pump 201R (ink flow rate by means of the pump driving) is set to be slower relative to the left pump 201L, thereby the print head 2 going into the pressurizing state.

At that time, due to a pressure loss within the ink passage in the print head 2, the nozzle of the nozzle chip near the left pump 201L that is the pressure source discharges ink earlier than the nozzle of the nozzle chip far from the left pump 201L. This results in larger amount of ink being discharged from the nozzle of the nozzle chip near the pump 201L. As shown in a thick arrow in figure, the amount of ink discharged from the nozzle of the nozzle chip near the left pump 201L becomes larger. Then, the pressurizing operation is carried out as shown in FIG. 12A, and then the pressurizing operation is carried out as shown in FIG. 12B.

Both the valve 203L and the valve 203R are opened and the driving speed of the left pump 201L is set to be slower relative to the right pump 201R, thereby the print head going into the pressurizing state. The amount of ink discharged from the nozzle chip on the left side in figure increases in FIG. 12A, while the amount of ink discharged from the nozzle chip on the right side increases as shown in figure by a thick arrow in FIG. 12B. As described above, the pressurizing operation is carried out sequentially from two directions as shown in FIGS. 12A and 12B, so that it is possible to equalize the amount of ink discharged from the plurality of nozzle chips. Therefore, it is possible to prevent the waste of ink consumption when the print head discharges the necessary amount of ink for removing the ink whose viscosity increases and eliminating microbubbles.

Thereby, it has been possible to achieve the ink jet printing apparatus which can reduce waste ink as much as possible and shorten the amount of time spent on the following wiping process.

Third Embodiment

A third embodiment of the present invention will be described below with reference to drawings. Since the basic structure of the present embodiment is similar to that of the first embodiment, description will be made below only regarding the characteristic structure.

Figure 13:
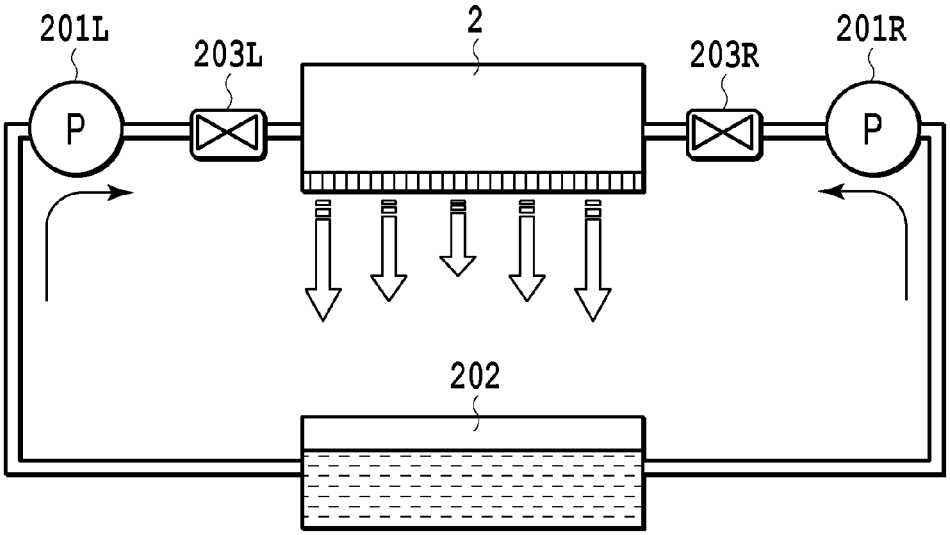
FIG. 13 is a schematic diagram showing a pressurizing operation which is a feature of a third embodiment.

FIG. 13 is a schematic diagram showing a pressurizing operation that is the characteristic of the present embodiment. Also in the present embodiment, the pressurizing operation is carried out while both the valve 203L and the valve 203R are opened, likewise the second embodiment. The pump operation is different from that in the second embodiment, however, in which the left pump 201L is driven in the forward direction (from the ink tank to the print head) and the right pump 201R is driven (simultaneously) in the reverse direction (from the ink tank to the print head) so as to apply the pressure to the print head 2 from both sides.

At that time, due to a pressure loss within the ink passage in the print head 2, the nozzle of the nozzle chip near the left pump 201L that is the pressure source and the nozzle of the nozzle chip near the right pump 201R discharge ink earlier than the nozzle in the central area. Therefore, a delay occurs in discharge of ink from the nozzle of the nozzle chip in the central area. This results in somewhat larger amount of ink being discharged from the nozzles of the nozzle chips near the left and right pumps than the ink discharged from the nozzle in the central area, as shown by a thick arrow in figure.

Unlike the aspect of applying pressure from one side as shown in FIG. 11A, however, applying pressure from both sides as described in the present embodiment makes it possible to reduce the effect due to the pressure loss within the ink passage in the print head 2. Therefore, the difference in the amount of ink to be discharged can be reduced, so that it is possible to prevent the waste of ink consumption when the print head discharges the necessary amount of ink for removing the ink whose viscosity increases and eliminating microbubbles.

Thereby, it has been possible to achieve the ink jet printing apparatus which can reduce waste ink as much as possible and shorten the amount of time spent on the following wiping process.

Fourth Embodiment

A fourth embodiment of the present invention will be described below. Since the basic structure of the present embodiment is similar to that of the first embodiment, description will be made below only regarding the characteristic structure.

Only the pressurizing operation have been described in the first, second and third embodiments. Since some ink spills out of the nozzle at the time of pressurizing operation, however, the wiping process is required for wiping the ink from the nozzle surface before the next printing is carried out. Then, in the present embodiment, the wiping operation will be carried out to the nozzle surface by the suction ports 11 shown in FIG. 9.

The suction ports 11, which are connected with the negative pressure generating device, can thus carry out the wiping operation while generating the negative pressure. Since the negative pressure is applied to the inside of the suction ports 11, the wiping can be carried out while the ink spilled out of the nozzle is sucked. This makes it possible to wipe the ink from the nozzle surface in a single wiping operation.

Thereby, it has been possible to achieve the ink jet printing apparatus which can reduce waste ink as much as possible and shorten the amount of time spend on the following wiping process.

Other Embodiment

Although the first and second embodiments exemplify the order of the directions of applying pressure at the time of pressurizing operation in a manner such that the pressurizing operation is carried out from the left side followed by the pressurizing operation from the right side, the order may be reversed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-074709, filed Mar. 28, 2012, which is hereby incorporated by reference herein in its entirety.

What is claimed is:

1. A printing apparatus, comprising:

an ink reservoir portion for storing ink;

a print head having nozzle arrays including a plurality of nozzles arranged thereon, the plurality of nozzles ejecting ink supplied from the ink reservoir portion;

a first ink passage connecting one end side of the nozzle arrays and the ink reservoir portion;

a second ink passage connecting the other end side of the nozzle arrays and the ink reservoir portion; and a control device adapted to execute a first operation and a second operation, wherein, the first operation is supplying ink from the ink reservoir portion to the print head by way of the first ink passage while the second ink passage is blocked, and discharging ink from the print head, and the second operation is supplying ink from the ink reservoir portion to the print head by way of the second ink passage while the first ink passage is blocked, and discharging ink from the print head.

2. The printing apparatus according to claim 1, wherein the control device alternately executes the first operation and the second operation.

3. A printing apparatus, comprising:

an ink reservoir portion for storing ink;

a print head having nozzle arrays including a plurality of nozzles arranged thereon, the plurality of nozzles ejecting ink supplied from the ink reservoir portion;

a first ink passage connecting one end side of the nozzle arrays and the ink reservoir portion;

a second ink passage connecting the other end side of the nozzle arrays and the ink reservoir portion; and a control device adapted to execute a first operation and a second operation simultaneously, wherein, the first operation is supplying ink from the ink reservoir portion to the print head by way of the first ink passage and discharging ink from the print head, and the second operation is supplying ink from the ink reservoir portion to the print head by way of the second ink passage and discharging ink from the print head.

4. The printing apparatus according to claim 1, wherein the control device controls the flow speed of the ink in the first ink passage and the second ink passage.

5. The printing apparatus according to claim 4, further comprising a first pump provided in the first ink passage and configured to supply ink, and a second pump provided in the second ink passage and configured to supply ink, wherein the control device controls the first pump and the second pump.

6. The printing apparatus according to claim 1, further comprising:

a wiping member configured to execute a wiping operation to wipe a nozzle surface, the nozzle arrays being provided on the nozzle surface, wherein the control device executes the first operation and the second operation, followed by the wiping operation.

7. The printing apparatus according to claim 6, wherein the wiping member has a negative pressure generating device for generating a pressure for sucking the ink from the plurality of nozzles.

8. A method for controlling a printing apparatus, the printing apparatus provided with an ink reservoir portion for storing ink, a print head having nozzle arrays including a plurality of nozzles arranged thereon, the plurality of nozzles ejecting ink an supplied from the ink reservoir portion, a first ink passage connecting one end side of the nozzle arrays and the ink reservoir portion, and a second ink passage connecting the other end side of the nozzle arrays and the ink reservoir portion, the method comprising:

a first process for supplying ink from the ink reservoir portion to the print head by way of the first ink passage while the second ink passage is blocked, and discharging ink from the print head; and a second process for supplying ink from the ink reservoir portion to the print head by way of the second ink passage while the first ink passage is blocked, and discharging ink from the print head.

9. The method for controlling a printing apparatus according to claim 8, further comprising alternately executing the first process and the second process.

10. A method for controlling a printing apparatus, the printing apparatus provided with an ink reservoir portion for storing ink, a print head having nozzle arrays including a plurality of nozzles arranged thereon, the plurality of nozzles ejecting ink supplied from the ink reservoir portion, a first ink passage connecting one end side of the nozzle arrays and the ink reservoir portion, and a second ink passage connecting the other end side of the nozzle arrays and the ink reservoir portion, the method comprising:

a first process for supplying ink from the ink reservoir portion to the print head by way of the first ink passage and discharging ink from the print head; and a second process for supplying ink from the ink reservoir portion to the print head by way of the second ink passage and discharging ink from the print head, wherein, the first process and the second process are executed simultaneously.

11. The method for controlling a printing apparatus according to claim 8, the printing apparatus being further provided with a wiping member configured to execute a wiping operation to wipe a nozzle surface the nozzle arrays being provided on the nozzle surface, the method further comprising a process for executing the wiping operation after the first process and the second process.

* * * * *